US007261618B2

(12) United States Patent
Brutus

(10) Patent No.: US 7,261,618 B2
(45) Date of Patent: Aug. 28, 2007

(54) DEVICE AND METHOD FOR ABRADING A WOODEN BARREL

(75) Inventor: Michel Jean Julien Brutus, Jonzac (FR)

(73) Assignee: Tonnellerie Radoux, Jonzac (FR)

( * ) Notice: Subject to any disclaimer, the term of this patent is extended or adjusted under 35 U.S.C. 154(b) by 0 days.

(21) Appl. No.: 10/532,661

(22) PCT Filed: Oct. 28, 2003

(86) PCT No.: PCT/FR03/03207

§ 371 (c)(1),
(2), (4) Date: Apr. 10, 2006

(87) PCT Pub. No.: WO2004/039537

PCT Pub. Date: May 13, 2004

(65) Prior Publication Data

US 2006/0223416 A1 Oct. 5, 2006

(30) Foreign Application Priority Data

Oct. 28, 2002 (FR) ..... 02 13459

(51) Int. Cl.
*B24B 1/00* (2006.01)

(52) U.S. Cl. ..... 451/59; 451/65; 451/168

(58) Field of Classification Search ..... 451/59, 451/57, 65, 51, 168, 296, 5, 8, 11
See application file for complete search history.

(56) References Cited

U.S. PATENT DOCUMENTS

| | | | | |
|---|---|---|---|---|
| 1,912,956 A | | 6/1933 | Weisbrod | |
| 1,939,674 A | | 12/1933 | Elskamp | |
| 4,279,282 A | * | 7/1981 | Whyte | 147/9 |
| 5,630,265 A | * | 5/1997 | Stone | 29/402.06 |

FOREIGN PATENT DOCUMENTS

| | | |
|---|---|---|
| GB | 2 154 488 | 9/1985 |

* cited by examiner

*Primary Examiner*—Dung Van Nguyen
(74) *Attorney, Agent, or Firm*—Young & Thompson

(57) ABSTRACT

A device for abrading a wooden barrel (13) includes a robot having elements (11, 17, 23) for loading a barrel (13), elements (29*a*, 29*b*, 33*a*, 33*b*) for gripping and rotating the barrel (13) around the axis thereof, elements (43*a*, 43*b*) for extracting and re-positioning the two bilge hoops of the barrel, elements (53) for abrading the barrel, and elements (69) for removing the barrel (13).

21 Claims, 2 Drawing Sheets

DEVICE AND METHOD FOR ABRADING A WOODEN BARREL

BACKGROUND OF THE INVENTION

1. Field of the Invention

The present invention relates to a device and a method for abrading, i.e. sanding, a wooden barrel.

2. Description of the Related Art

Traditionally, in barrel works, wooden barrels are sanded entirely manually: an operative loads the barrel onto a lathe, removes a first bilge hoop (a metal ring situated in the largest diameter region, known as the "bilge") with a hammer and a drift, sands a first half of the barrel with a belt sander, replaces the first bilge hoop, removes the second bilge hoop, sands the second half of the barrel, replaces the second bilge hoop, and finally unloads the barrel from the lathe.

Apart from the fact that these operations are physically very tiring, the operative must work in a very dusty atmosphere.

Moreover, it takes a relatively long time to sand a barrel using the traditional technique.

An object of the present invention is to provide a device and a method that overcome these drawbacks.

SUMMARY OF THE INVENTION

That object of the invention is achieved with a device for sanding a wooden barrel, characterized in that it consists of a robot comprising:

means for loading said barrel, means for gripping and rotating said barrel around the axis thereof, means for removing and replacing the two bilge hoops of said barrel, means for sanding said barrel, and means for removing said barrel.

Clearly, the device of the invention robotizes tasks that were previously difficult and lengthy, and thereby achieves the required improvement.

According to other features of the device of the invention:

said gripping and rotating means comprise two mobile headstocks moving symmetrically and each including extendable clamping jaws, said hoop removing and replacing means comprise a plurality of arms mounted to be mobile between an open position in which they are moved away from said barrel and a closed position in which they are able to grip one of said bilge hoops and to slide along the axis of said barrel, said arms are mounted on a carriage adapted to slide between a first position in which said arms face one of said bilge hoops and a second position in which said arms face the other of said bilge hoops, said arms comprise clamping shoes conformed to be applied to either of said bilge hoops interchangeably, said device comprises means for preventing said arms from gripping each of said bilge hoops too tightly, there are four arms, said sanding means comprise a sanding head including a belt sander, said sanding head is mounted so that it is able to slide along the axis of said barrel, said device comprises means for varying the distance of said sanding head from the axis of said barrel, said distance varying means comprise a deformable parallelogram, said device comprises means for varying the inclination of said sanding head to the axis of said barrel, said device comprises means for adjusting the pressure exerted on said barrel by said sanding head, said device comprises a safety enclosure with an entry airlock and an exit airlock for said barrel, said device comprises means for sequencing the passage of said barrel into said entry airlock, said device comprises means for identifying the position of the bunghole of said barrel, said device comprises means for immobilizing and lifting said barrel.

The method of the invention, applied to the above device, is characterized in that it comprises the steps of:

a) placing said barrel between said gripping and rotating means, b) gripping said barrel with said gripping and rotating means, c) removing one of said bilge hoops on one half of said barrel with said hoop removing and replacing means, d) rotating said barrel with said gripping and rotating means, e) sanding said half barrel with said sanding means, f) stopping the rotation of said barrel, g) replacing said bilge hoop with said hoop removing and replacing means, h) repeating steps c) to g) for the other bilge hoop and the other half of said barrel, and i) releasing said barrel from said gripping and rotating means.

According to other features of the method of the invention:

for executing said step e), said sanding head is moved in the direction of the axis of said barrel, between said steps b) and c), the position of said bunghole is identified in order to position said barrel so that said hoop removing and replacing means do not interfere with riveted areas of said bilge hoops, to execute said step c), said barrel is rotated so that it occupies a plurality of successive positions and, in each of said positions, removal forces are exerted on said bilge hoop with said hoop removing and replacing means.

BRIEF DESCRIPTION OF THE DRAWINGS

Other features and advantages of the invention will become apparent in the light of the following description and on examining the appended drawings, in which.

DESCRIPTION OF THE PREFERRED EMBODIMENTS

Figure 1:
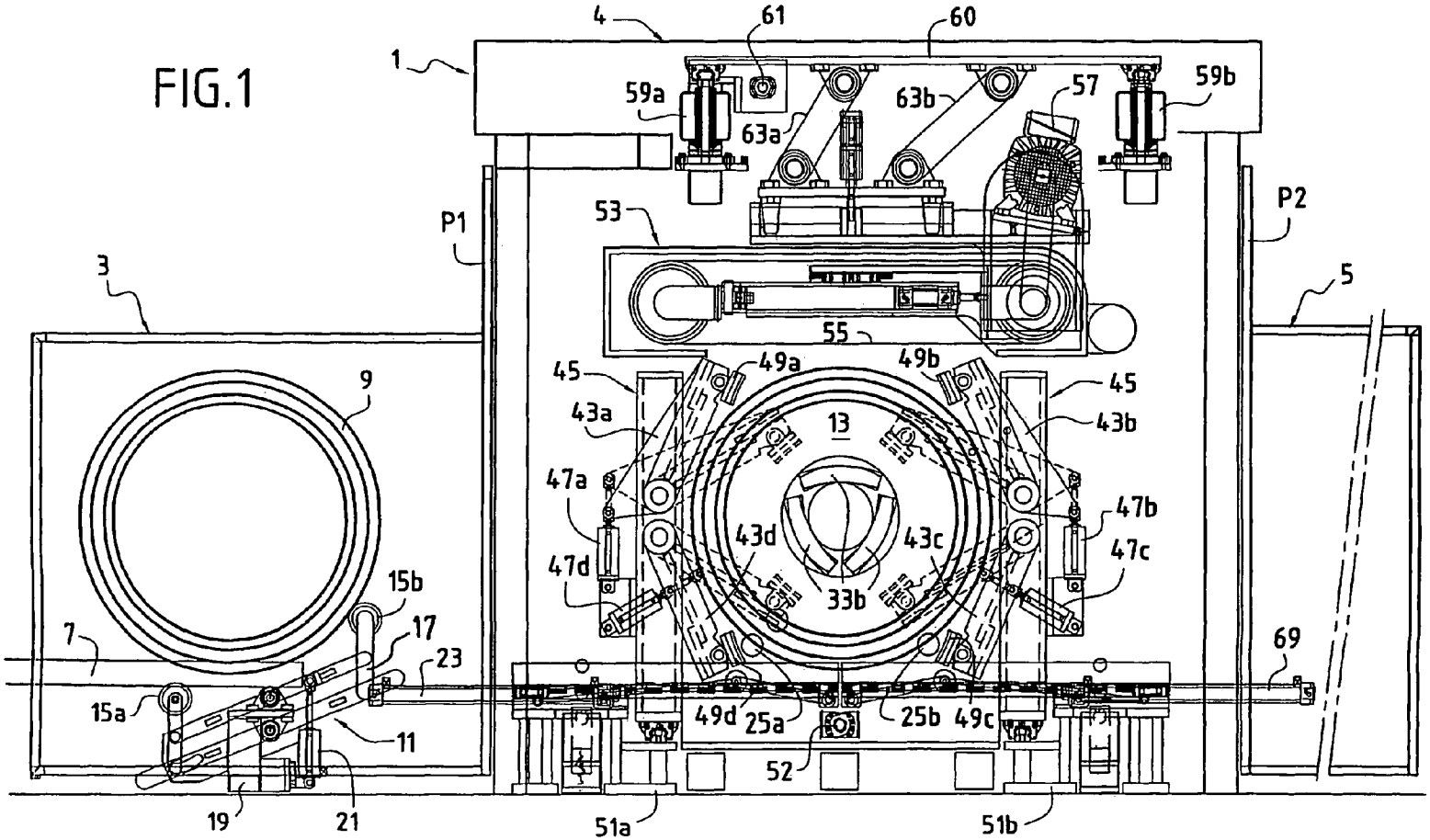
FIG. 1 is a front view of the device of the invention.

FIG. 1 of the appended drawings shows that the device of the invention comprises a safety enclosure 1 that is preferably soundproofed and comprises an entry airlock 3, a main chamber 4 and an exit airlock 5.

Doors P1 and P2 separate the entry airlock 3 from the main chamber 4 and the main chamber from the exit airlock 5, respectively.

A pair of parallel rails with a slight inclination known as a track 7 terminates in the entry airlock 3 and conveys thereto a barrel 9 to be processed.

A sequencer device 11 immobilizes the barrel 9 to be processed in the entry airlock 3 until the processing of the preceding barrel 13 has been completed.

The sequencer device 11 may comprise rollers 15*a*, 15*b* rotatably mounted at the two ends of a deformable parallelogram 17 mounted pendulum-fashion on a support 19 and actuated by a cylinder 21.

A track 23 links the entry airlock 3 to the main chamber 4.

The main chamber 4 contains means for immobilizing and lifting the barrel 13 before it is processed.

Figure 2:
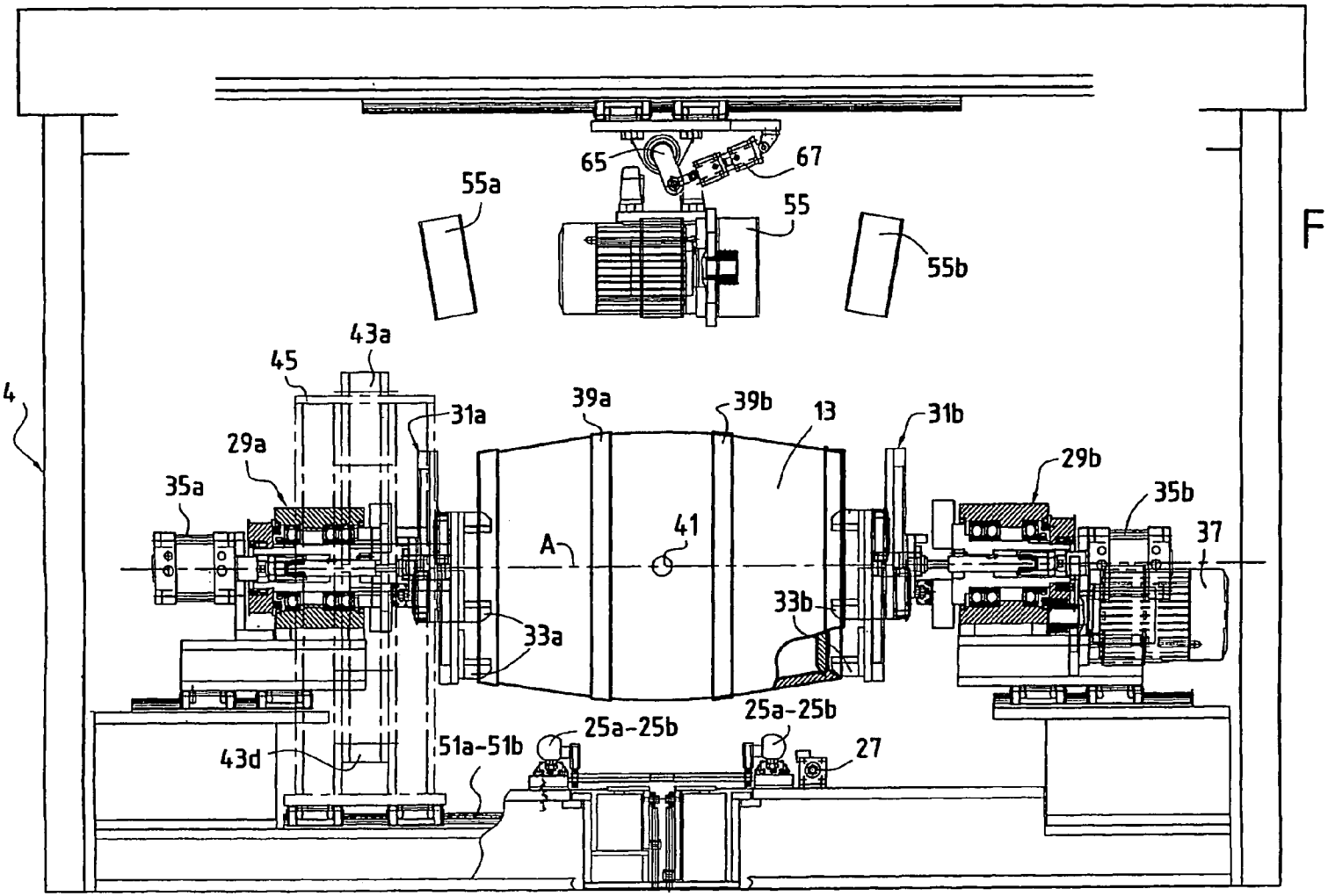
FIG. 2 is a side view of the device of the invention.

As is apparent in FIGS. 1 and 2, those means may comprise buffers 25*a*, 25*b* that are raised by a lead screw 27 until they come into contact with and then lift the barrel 13.

The main chamber 4 further contains means for gripping the barrel 13 and rotating it about its axis A.

As may be seen in FIGS. 1 and 2, those means may comprise two motorized mobile headstocks 29*a*, 29*b* each including a chuck 31*a*, 31*b* with extendable jaws 33*a*, 33*b*.

The term "extendable" means that the jaws 33*a*, 33*b* can be moved in the direction of the axis A of the barrel 13 by pneumatic cylinders 35*a*, 35*b* visible in FIG. 2.

A high-power electric motor 37 is adapted to drive rotation of the chuck 31*b*.

The main chamber 4 further contains means for removing and replacing the two bilge hoops 39*a*, 39*b* of the barrel 13.

As can be seen in FIG. 2, the bilge hoops are the metal hoops that are situated in the bulging portion of the barrel 13, known as the "bilge", one on each either side of the bunghole 41.

The hoop removing and replacing means comprise a plurality of arms, preferably four arms 43*a* to 43*d* as shown in FIG. 1, mounted on a carriage 45 to pivot about axes parallel to the axis A of the barrel.

These arms are therefore mobile between an open position, represented in thicker line in FIG. 1, in which they are moved away from the bilge hoops 39*a*, 39*b*, and a closed position, represented in thinner line in FIG. 1, in which they are able to grip the bilge hoops.

The arms 43*a* to 43*d* are actuated in these two positions by cylinders 47*a* to 47*d* disposed between the arms and the carriage 45.

As can be seen in FIG. 1, the ends of the arms 43*a* to 43*d* carry clamping shoes 49*a* to 49*d* mounted to rotate relative to the arms about axes parallel to the axis A of the barrel 13.

The clamping shoes are conformed so that they are able to cooperate firmly with either of the bilge hoops 39*a*, 39*b*.

Pressure sensors known in the art (not shown) are preferably provided so that the arms 43*a* to 43*d* do not apply too high or too low a pressure to the bilge hoops 39*a*, 39*b* after their removal.

The carriage 45 is mounted to be slid along the axis A of the barrel 13 by appropriate conventional means, for example rails 51*a* and 51*b* and a lead screw 52 extending along the axis A.

The main chamber 4 further contains means for sanding the barrel 13.

As is apparent in FIGS. 1 and 2, those means comprise a sanding head 53 including a sanding belt 55 driven by an electric motor 57 in a direction substantially transverse to the axis A of the barrel 13.

The sanding head is suspended from a frame 60 mounted to be slid along the axis A of the barrel 13 by appropriate conventional means, for example rails 59*a* and 59*b* and a lead screw 61 extending along the axis A.

Means are provided for varying the distance of the sanding head 53 from the axis A of the barrel 13.

As can be seen in FIG. 1, those means may comprise two links 63*a*, 63*b* linking the sanding head 53 to the frame 60 and substantially defining a deformable parallelogram.

Means are also provided for varying the inclination of the sanding head 53 to the axis A of the barrel 13.

As can be seen in FIG. 2, those means comprise an arm 65 for rotating the head 53 relative to the frame 60 about a substantially horizontal axis perpendicular to the axis A of the barrel 13 and a cylinder 67 for actuating the arm 65 disposed between the head 53 and the frame 60.

Means known in the art and not shown ensure that the sanding belt 55 applies a constant pressure to the barrel 13.

As can be seen in FIG. 1, a track 69 connects the main chamber 4 to the exit airlock 5.

Means known in the art are also provided for marking the position of the bunghole 41. Those means may comprise a photoelectric cell, for example (not shown).

All of the moving parts of the device of the invention are controlled by an electronic circuit connected to a man/machine interface (not shown) enabling an operative to fix set points associated with each type of barrel to be processed.

The operation and the advantages of the device of the invention are clear from the foregoing description.

The barrel to be processed arrives in the entry airlock 3, rolling along the track 7, and reaches the position 9 represented in FIG. 1.

The sequencer 11, which is in the position represented in FIG. 1 for as long as the preceding barrel 13 is being sanded in the chamber 4, immobilizes the barrel 9 inside the airlock 3.

When the sanding of the preceding barrel 13 has been finished and that barrel has left the chamber 4, the cylinder 21 pivots the sequencer 11 so that the roller 15*a* is in the raised position and the roller 15*b* is in the lowered position.

The door P1 is then opened and the barrel 9 rolls along the track 23 into the chamber 4, until it reaches the position 13 seen in FIG. 1. The door P1 is then closed.

Driven by the lead screw 53, the buffers 25*a*, 25*b* come into contact with the barrel 13 and then lift it until it reaches a position in which its axis A is substantially aligned with the rotation axes of the headstocks 29*a* and 29*b* (see FIG. 2).

The pneumatic cylinders 35*a*, 35*b* then place the jaws 33*a*, 33*b* of the chucks 31*a*, 31*b* against the two ends of the barrel 13 to hold the barrel firmly.

The electric motor 37 rotates the barrel 13 so that the bunghole 41 moves in front of the photoelectric cell so that it may be identified.

Once this identification has been effected, the barrel 13 continues to turn to a position in which it is certain that the shoes 49*a* to 49*d* will be pressed onto areas of the bilge hoops 39*a*, 39*b* with no rivets.

In other words, identifying the position of the bunghole 41 indexes the angular position of the barrel 13 in order to optimize the gripping of the bilge hoops 39*a*, 39*b* by the arms 43*a* to 43*d*.

The carriage 45 then slides on the rails 51*a*, 51*b* until the arms 49*a* to 49*d* are in line with the bilge hoop 39*a*.

The cylinders 47*a* to 47*d* are then actuated so that the shoes 49*a* to 49*d* are pressed onto the bilge hoop 39*a* and grip it.

The carriage 45 then slides to remove the bilge hoop and then pass it over the head of the barrel 13.

Once it has been extracted, the gripping force applied to the bilge hoop 39*a* by the arms 43*a* to 43*d* is controlled so that the arms do not crush the hoop.

Note that if removing a hoop proves difficult, removing it in several stages may be envisaged, turning the barrel through a certain angle (for example 45°) between attempts.

The barrel 13 is then rotated continuously by the electric motor 37.

The deformable parallelogram 63*a*, 63*b* then lowers the sanding head 53 until the sanding belt 55 comes into contact with the head of the barrel 13.

The motor 57 is then started, which drives the sanding belt 55.

While the barrel 13 is turning about its axis, the sanding head 53 slides on the rails 59*a*, 59*b*.

The relative speeds of rotation of the barrel 13, on the one hand, and of translation of the head 53, on the other hand, are adapted so that a single excursion of the head 53 between the end and the bilge of the barrel 13 is sufficient to sand half of the barrel.

Once this sanding has been effected, the bilge hoop 39*a* is replaced by a sequence of operations in the reverse order to that described above: the carriage 45 slides to reposition the hoop 39*a* on the bilge of the barrel 13, after which the arms 43*a* to 43*d* are moved apart to release the hoop.

All of the steps described above are then repeated to remove/replace the other bilge hoop 39*b* and sand the second half of the barrel 13.

It will be noted that while the sanding head 53 is advancing, its inclination to the axis A of the barrel is adjusted by the cylinder 67 operating on the arm 65.

Thus the sanding belt 55 can at all times be tangential to the generatrices of the barrel 13.

For example, FIG. 2 shows two different inclinations of the belt 55, corresponding to positions in which the belt is in the regions of the heads 55*a*, 55*b* or the bilge 55 of the barrel 13.

As is clear in the light of the foregoing description, only one bilge hoop is removed at a time, which means that the staves forming the barrel are held together while the corresponding half of the barrel is sanded, which prevents sawdust penetrating to the interior of the barrel.

Once the whole of the barrel has been sanded, the sanding head 53 is raised by the links 63*a*, 63*b*, rotation of the barrel is stopped, the jaws 33*a*, 33*b* are opened, the barrel is lowered onto the track 69, the door P2 is opened, and the barrel is evacuated into the exit airlock 5.

The next barrel can then be sanded in its turn.

As is clear in the light of the foregoing description, the device of the invention is able to sand wooden barrels entirely automatically, so that the irksome and lengthy manual operations of the prior art can be dispensed with.

For example, the device of the invention is able to sand a 228-liter barrel in less than two minutes.

Of course, the present invention is not limited to the embodiment described and shown, which is provided by way of illustrative and nonlimiting example.

The invention claimed is:

1. Device for sanding a wooden barrel, consisting of a robot comprising:

means for loading said barrel, means for gripping and rotating said barrel around the axis thereof, means for removing and replacing the two bilge hoops of said barrel, means for sanding said barrel, and means for removing said barrel.

2. Device according to claim 1, wherein said gripping and rotating means comprise two mobile headstocks moving symmetrically and each including extendable clamping jaws.

3. Device according to claim 1, wherein said hoop removing and replacing means comprise a plurality of arms mounted to be mobile between an open position in which they are moved away from said barrel and a closed position in which they are able to grip one of said bilge hoops and to slide along the axis of said barrel.

4. Device according to claim 3, wherein said arms are mounted on a carriage adapted to slide between a first position in which said arms face one of said bilge hoops and a second position in which said arms face the other of said bilge hoops.

5. Device according to claim 4, wherein said arms comprise clamping shoes conformed to be applied to either of said bilge hoops interchangeably.

6. Device according to claim 3, comprising means for preventing said arms from gripping each of said bilge hoops too tightly.

7. Device according to claim 3, comprising four arms.

8. Device according to claim 1, wherein said sanding means comprise a sanding head including a belt sander.

9. Device according to claim 8, wherein said sanding head is mounted so that it is able to slide along the axis of said barrel.

10. Device according to claim 9, comprising means for varying the distance of said sanding head from the axis of said barrel.

11. Device according to claim 10, wherein said distance varying means comprise a deformable parallelogram.

12. Device according to claim 8, comprising means for varying the inclination of said sanding head to the axis of said barrel.

13. Device according to claim 8, comprising means for adjusting the pressure exerted on said barrel by said sanding head.

14. Device according to claim 1, comprising a safety enclosure with an entry airlock and an exit airlock for said barrel.

15. Device according to claim 14, comprising means for sequencing the passage of said barrel into said entry airlock.

16. Device according to claim 1, comprising means for identifying the position of the bunghole of said barrel.

17. Device according to claim 1, comprising means for immobilizing and lifting said barrel.

18. Method applied to a device according to claim 1, comprising the steps of:

a) placing said barrel between said gripping and rotating means, b) gripping said barrel with said gripping and rotating means, c) removing one of said bilge hoops on one half of said barrel with said hoop removing and replacing means, d) rotating said barrel with said gripping and rotating means, e) sanding said half barrel with said sanding means, f) stopping the rotation of said barrel, g) replacing said bilge hoop with said hoop removing and replacing means, h) repeating steps c) to g) for the other bilge hoop and the other half of said barrel, and i) releasing said barrel from said gripping and rotating means.

19. Method according to claim 18 applied, wherein, for executing said step e), a sanding head is moved in the direction of the axis of said barrel.

20. Method according to claim 18, wherein, between said steps b) and c), the position of a bunghole of the barrel is identified in order to position said barrel so that said hoop removing and replacing means do not interfere with riveted areas of said bilge hoops.

21. Method according to claim 1, wherein, to execute said step c), said barrel is rotated so that it occupies a plurality of successive positions and, in each of said positions, removal forces are exerted on said bilge hoop with said hoop removing and replacing means.

* * * * *